US007809491B1

(12) United States Patent
Bevan et al.

(10) Patent No.: US 7,809,491 B1
(45) Date of Patent: Oct. 5, 2010

(54) METHOD TO PERFORM CARBON CANISTER PURGE AND ADAPTION OF AIR-FUEL RATIO ESTIMATION PARAMETERS

(75) Inventors: David Michael Bevan, Northville, MI (US); Kenneth James Miller, Canton, MI (US); Douglas Raymond Martin, Canton, MI (US); David Allen Clemens, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 12/471,877

(22) Filed: May 26, 2009

(51) Int. Cl.
*F02M 33/02* (2006.01)
*F02D 41/26* (2006.01)

(52) U.S. Cl. ..... 701/103; 701/113; 701/115; 123/520; 123/480; 123/486

(58) Field of Classification Search ..... 123/520, 123/518, 480, 486; 701/102, 103, 106, 113, 701/115
See application file for complete search history.

(56) References Cited

U.S. PATENT DOCUMENTS 5,464,000 A 11/1995 Pursifull et al.
6,523,531 B1 2/2003 Feldkamp et al.
6,622,691 B2 * 9/2003 Bagnasco et al. ..... 123/295
6,778,898 B1 8/2004 Bidner et al.

* cited by examiner

*Primary Examiner*—Hai H Huynh
(74) *Attorney, Agent, or Firm*—David B. Kelley; Brooks Kushman P.C.

(57) ABSTRACT

A control scheme is disclosed for performing both an adaption routine and carbon canister purging. In adaption, parameters for estimating air-fuel ratio from flow sensors and actuators are adjusted against an air-fuel ratio under closed-loop control using an EGO sensor. The two processes cannot run simultaneously. In vehicles in which the engine is operating from the time of key on until key off, the adaption occurs shortly after starting and then periodically thereafter. In vehicles in which the engine is turned on and off frequently such as with HEVs, the adaption routine may be run every time the engine is turned on, which is more frequent than necessary and doesn't allow enough time for purging. According to the disclosed control scheme, the time since last adaption and time in adaption is saved when the engine is turned off so that the adaption routine is conducted only when needed.

19 Claims, 3 Drawing Sheets

Increment TSLA timer
TSLA timer not incremented
100
Key-on
102
Start = Key on
104
Reset TLSA and TA
106
OK to purge ?
No
Yes
108
Turn on purge
110
Engine running ?
No
Yes
112
Turn off purge
114
Save TSLA and TA
116
Engine running ?
No
Yes
118
Is Start = Key-on OR TSLA > TSLA threshold OR TA > 0 ?
No
Yes
120
Conditions OK to purge ?
No
Yes
a
b
c
d

METHOD TO PERFORM CARBON CANISTER PURGE AND ADAPTION OF AIR-FUEL RATIO ESTIMATION PARAMETERS

BACKGROUND

1. Technical Field

The disclosure relates to controlling fuel vapor purging of a hybrid electric vehicle as well as for performing adaptive learning of sensors providing information relevant to air-fuel ratio calculations.

2. Background Art

Engine fuel systems contain a carbon canister for collecting fuel vapors produced in the fueling system, in which fuel vapors adsorb onto carbon pellets within the carbon canister. The capacity of the carbon pellets for storing fuel vapors is finite. Thus, periodically, the carbon canister undergoes a purge process in which fresh air is drawn from the atmosphere into the carbon canister. The fuel vapors are desorbed from the carbon pellets and the vapor laden air is drawn into the engine where it is burned during engine combustion.

Engines also have air-fuel ratio control methods. In some operating modes, the engine is operated closed-loop to control air-fuel ratio. Closed-loop feedback control is based on a signal from an exhaust gas oxygen sensor in the engine exhaust. In other operating modes, air-fuel ratio is controlled open-loop based on signals from a sensor in the engine intake from which air flow rate can be computed and fuel pulse width commanded to the injectors from which fuel flow rate can be computed. Closed-loop control is preferred, but cannot always be used, e.g., when the exhaust gas oxygen sensor is cooler than its operating temperature, when the engine undergoes severe transients in which the delay from what is happening upstream of the engine to the exhaust gas oxygen sensor located in the exhaust stream is too long, and when the engine is operated at an air-fuel ratio away from stoichiometric. The sensors and actuators upon which the open-loop control relies to determine fuel and air flow rates vary from engine to engine and vary over time. To ensure accuracy of the open-loop control, closed-loop measurements are compared with open-loop measurements periodically. If a difference is detected, parameters in the open-loop computation are adjusted to account for the variability encountered.

Purging of the carbon canister provides fuel into the combustion chamber in excess of what is injected by fuel injectors. The amount of fuel injected by the injectors is decreased to compensate for the purge fuel. Because the fuel inducted into the engine is in excess of the injected fuel, if an adaption routine were conducted simultaneously with purging, the open-loop parameters would be inaccurate. Thus, purging is turned off when the adaption routine is conducted. It is found that to adequately purge the carbon canister, purging is commanded substantially whenever engine conditions allow it.

In the prior art, the adaption routine is commanded to run as soon as possible after the engine has been started, which impacts the time allowable for purging, but not substantially. In hybrid electric vehicles (HEVs), however, because the engine is stopped and started frequently to improve the vehicle's fuel efficiency, the adaption routine is run much more frequently than is strictly necessary and it presents a substantial obstacle to purging the carbon canister. The reduction in purge opportunities increases the likelihood that the carbon canister becomes saturated, which would potentially allow exhausting of fuel vapors from the carbon canister. This may negatively impact the ability of the vehicle to meet the relevant emission standards.

SUMMARY

A method for controlling an internal combustion engine disposed in a vehicle is disclosed in which a time since last adaption (TSLA) timer is incremented while the engine is operating. If the engine is turned off, the value of TSLA is stored and the next increment of TSLA is performed using the saved value of TSLA. The adaption routine is conducted when TSLA has exceeded a TSLA threshold, meaning that sufficient engine operating time has elapsed and that adaption is needed. The TSLA timer is reset when the adaption routine is run. By saving the value of TSLA each time when the engine is turned off, it ensures that the adaption routine is conducted only when necessary, not upon each engine restart. Conducting an adaption routine may include: operating in a closed-loop air-fuel control mode to maintain a predetermined air-fuel ratio, estimating an open-loop air-fuel ratio based on present values of the parameters, adjusting the values of certain parameters used to estimate the open-loop air-fuel ratio when the difference between the predetermined air-fuel ratio and open-loop air-fuel ratio differ by more than a threshold, incrementing an adaption timer during the estimating and adjusting steps, and exiting the adaption routine and resetting the adaption timer when the adaption timer exceeds an adaption timer threshold. If the engine is stopped during an adaption routine, the adaption is halted and the value of the adaption timer is saved. The next incrementing of the adaption timer uses the saved value of the adaption timer to ensure that the adaption routine is not run for longer than needed when it is interrupted by an engine shut down event.

Also disclosed is a method to control an engine in which the engine start is detected and characterized as either a key-on start or a subsequent start. A key-on start is the engine start that accompanies the key-on operation, or in the event that the HEV operates in electric-only mode upon key on, key-on start is the first engine start after key on. An HEV may start and stop many times during a single trip while the key remains on. All other starts other than the key-on start are referred to herein as subsequent starts. The TSLA timer is incremented while the engine is operating. An adaption routine is conducted when the TSLA timer exceeds the TSLA threshold. The TSLA timer is reset in response to a key-on start. When there is a subsequent start, however, the value of the TSLA timer is saved. The saved TSLA timer value is used in the next incrementing of the TSLA. The adaption routine is run upon key-on starts and when the TSLA timer exceeds the TSLA threshold. By saving the TSLA timer value when the restart is a subsequent start, the adaption routine conducted after the TSLA timer indicates that engine running time has exceeded the TSLA threshold, not at every restart. Alternatively, the value of the TSLA timer is saved upon engine shut down, when the shut down is one in which the key is on.

At least one of the problems in the prior art is overcome by conducting adaption routines only as often as needed. By doing so, there is sufficient time for purging, thereby ensuring that the relevant emission standards can be attained.

An alternative solution is to provide a hardware solution, such as a carbon canister with a larger volume or a sealed fuel tank system. Hardware solutions are costly and add weight to the vehicle. An advantage of a software solution, according to an embodiment the present development, is that there are no design changes, no hardware additions, and no price increase incurred in the solution.

DETAILED DESCRIPTION

As those of ordinary skill in the art will understand, various features of the embodiments illustrated and described with reference to any one of the Figures may be combined with features illustrated in one or more other Figures to produce alternative embodiments that are not explicitly illustrated or described. The combinations of features illustrated provide representative embodiments for typical applications. However, various combinations and modifications of the features consistent with the teachings of the present disclosure may be desired for particular applications or implementations. The representative embodiments used in the illustrations relate generally to a vapor recovery system for a vehicle equipped with a gasoline fueled engine. Those of ordinary skill in the art may recognize similar applications or implementations consistent with the present disclosure for use in any vehicle using a carbon canister, particularly helpful in those with stop-start capability: HEVs and plug-in HEVs. Those of ordinary skill in the art will recognize that the teachings of the present disclosure may be applied to other applications or implementations.

Figure 1:
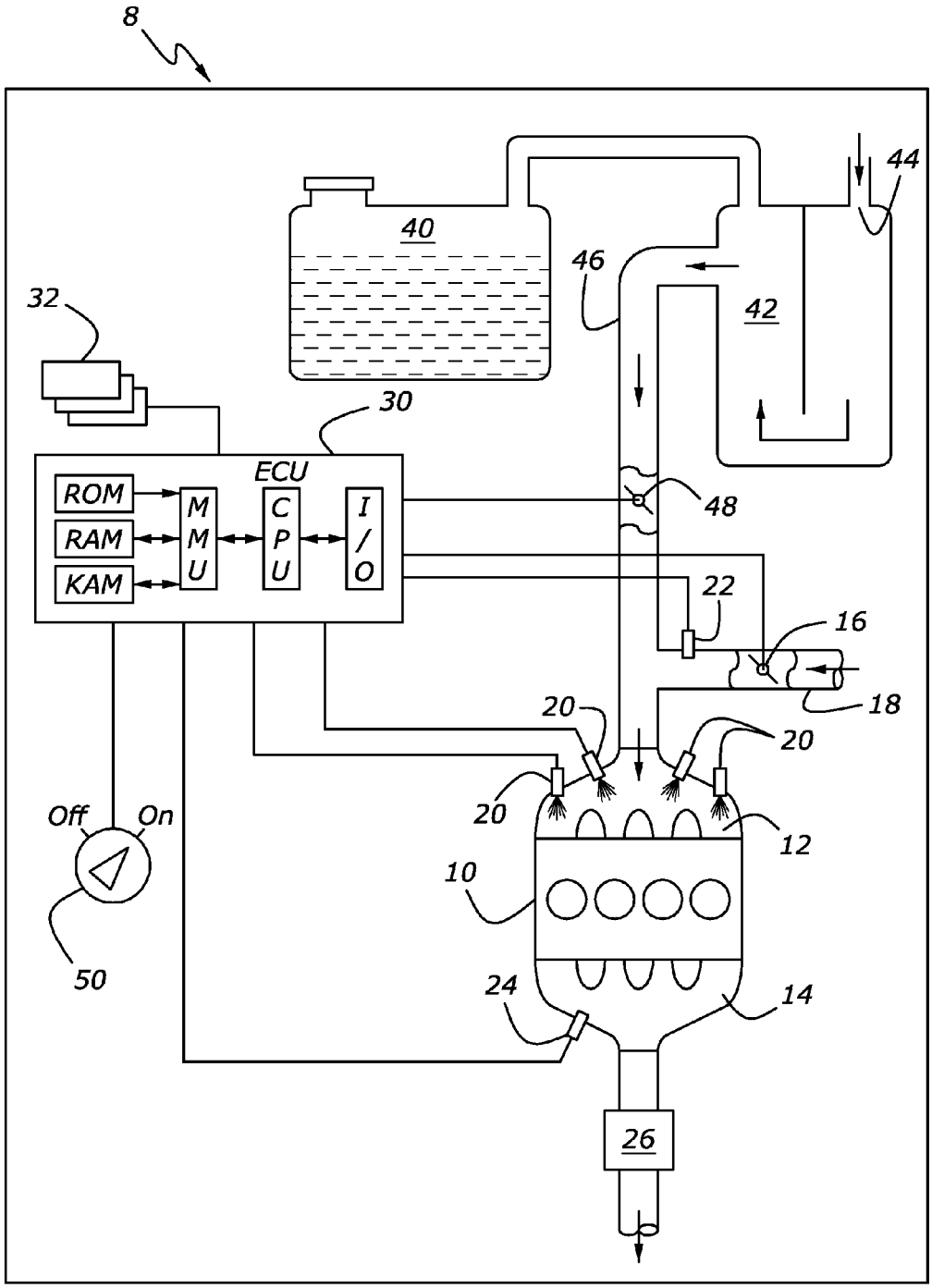
FIG. 1 is a schematic drawing of an engine showing the sensors and actuators associated with conducting an adaption routine for open-loop air-fuel ratio measurements and the carbon canister system used in purging.

An internal combustion engine 10 is shown in FIG. 1 disposed in a vehicle 8. Engine 10 is supplied fresh air through intake manifold 12 and exhaust gases leave through exhaust manifold 14. A throttle valve 16 in intake line 18 controls the amount of air inducted into engine 10. Fuel injectors 20 supply a metered amount of fuel to each of the engine cylinders. The injector arrangement in FIG. 1 is known as port fuel injected. However, direct injection, central injection, and gaseous injection are alternatives. A sensor 22 is placed in intake line 18 from which mass air flow can be computed. In one alternative sensor 22 is a mass air flow sensor. Alternatively, sensor 22 is a pressure sensor. Based on a signal from the pressure sensor and rotational speed of engine 10, mass flow rate of air can be determined. Exhaust manifold 14 has an exhaust gas oxygen (EGO) sensor 24. Based on a signal from sensor 24, fuel and air can be controlled to maintain a desired air-fuel ratio, often stoichiometric. Sensor 24 may be a heated EGO or universal EGO (UEGO), the former having a heater to bring the EGO up to operating temperature more quickly after a cold start of engine 10 and the latter allowing determination of air-fuel ratio over a wide range of air-fuel ratios. Exhaust manifold 14 supplies exhaust to a catalyst 26 for processing of exhaust gases prior to exhausting them to atmosphere.

Continuing with FIG. 1, electronic control unit (ECU) 30 is provided to control functions associated with engine 10. ECU 30 has one or more microprocessor central processing units (CPU) in communication with one or more memory management units (MMU). MMUs control the movement of data among the various computer readable storage media and communicate data to and from the CPUs. The computer readable storage media may include volatile and nonvolatile storage in read-only memory (ROM), random-access memory (RAM) and keep-alive memory (KAM), for example. KAM may be used to store various operating variables while a CPU is powered down. The computer-readable storage media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by CPU in controlling the engine or vehicle into which the engine may be mounted. The computer-readable storage media may also include floppy disks, CD-ROMs, hard disks, and the like. CPU communicates with various sensors and actuators 32 via input/output (I/O) interfaces, respectively. Some ECU 30 architectures do not contain a MMU. If no MMU is employed, the CPU manages data and connects directly to ROM, RAM, and KAM. For purposes of schematic illustration, all of the computing capability is shown as ECU 30, even though it should be appreciated that the computing capability may be distributed. Furthermore, the elements of ECU 30 may communicate among each other and with external sensors and actuators 32 by direct connection or wirelessly.

Continuing to refer to FIG. 1, fuel injectors 20 are supplied fuel from fuel tank 40 (connections not shown). Associated with fuel tank 40 is a carbon canister system, which includes carbon canister 42 fluidly communicating with fuel tank 40. When fuel tank 40 is filled, the vapors within fuel tank 40 are displaced and flow into carbon canister 42, which contains activated carbon pellets to adsorb the fuel. The air, which has been stripped of fuel vapors, exits to atmosphere through port 44. The arrows shown in FIG. 1 illustrate a purging operation, in which air flows in through port 44. In the collection or adsorption mode, air flows out port 44. Carbon canister 42 also communicates with engine intake 18 by line 46, in which a purge valve 48 is disposed. When purge valve 48 is open and there is a vacuum in the engine intake, fresh air is drawn from the atmosphere at port 44 into carbon canister 42, through line 46, through intake manifold 12 and into engine cylinders where the fuel is combusted. Purge flow is controlled by adjusting the open position of purge valve 48. Purge valve 48 may be an on-off valve which is pulse-width modulated to attain a desired position or is a variable valve commanded to the desired position.

There are two ways for determining air-fuel ratio: open-loop, which is determined based on signals from sensors and actuators without feedback. In one method, mass air flow is estimated based on a signal from sensor 22 and mass fuel flow is estimated based on the pulse width commanded to injectors 20. Alternatively, air-fuel ratio is determined by feedback on a signal from EGO 24, i.e., closed-loop control. When possible, ECU 30 relies on closed-loop control to maintain the appropriate air-fuel ratio. However, EGO 24 must be sufficiently warm to provide an accurate signal. Also, EGO 24 can provide delayed and/or confounded results when engine 10 undergoes extreme transients, such as a rapid tip in or tip out on an accelerator pedal. In addition, if EGO 24 only provides a useful signal near stoichiometric operation conditions (fuel and air are provided in such a ratio that there is sufficient air to consume all the fuel with no fuel leftover). There are operating conditions, e.g., enrichment for maximum torque, in which the air-fuel ratio is richer than stoichiometric. Note, however, if EGO 24 is a UEGO, then it can provide a measure of air-fuel ratio both lean and rich of stoichiometric. In any of these situations, open-loop control may be used. However, the sensors and actuators used to estimate open-loop air-fuel ratio may drift over time. For example, fuel injectors may experience a small amount of plugging or a bit of wear at the valve surfaces thereby changing their flow characteristics. Consequently, the amount of fuel injected as determined from pulse width becomes inaccurate. To ensure that the open-loop air-fuel ratio estimation remains accurate, an adaption routine may be run periodically during engine operation. When the engine is running closed-loop, likely at stoichiometric air-fuel ratio, an open-loop air-fuel ratio estimation is also performed. The open-loop and closed-loop air-fuel ratios are compared. If the difference is greater than a threshold, parameters used in algorithm to estimate open-loop air-fuel ratio based on the actuator/sensor signals are adjusted so that the two air-fuel ratios align.

If the adaption routine were conducted during purging of carbon canister 42, the EGO sensor 24 determination of air-fuel ratio remains accurate. However, the open-loop estimation of air-fuel ratio is uncertain because the sensors/actuators only have information about air that flows through intake 18 and fuel supplied by injectors 20. The open-loop estimation does not measure the fuel and air supplied to engine 10 from the carbon canister. Thus, to accurately adjust the parameters involved in the open-loop estimation, the adaption routine is operated while purge is disabled, i.e., purge valve 48 is closed. The adaption routine takes on the order of half a minute to run and is conducted as soon as conditions are appropriate after the engine is started and after about every 25 minutes of engine operation. The time intervals provided are merely one example and not intended to be limiting.

In some vehicles, engine 10 is stopped and started under ECU 30 control independently of the vehicle operator's control. In hybrid electric vehicles (HEVs), the vehicle has one or more propulsion sources coupled to the wheels: engine 10 and an electric motor. Engine 10 may be shut off during braking, idle, electric-only operation, etc. and then restarted when the vehicle operator depresses the accelerator pedal. A vehicle driven in stop-and-go traffic may have the engine 10 operate only 30 seconds out of every minute. If the adaption routine is conducted shortly after each start and restart, there is little time available for purging. This scenario occurs in HEVs or in vehicles utilizing frequent stop-starts while the key is on.

In one embodiment of the present disclosure, a distinction is made between a key-on start and subsequent starts. An ignition switch 50, in FIG. 1, coupled to ECU 30. Ignition switch 50 is an operator-selectable switch having a key-off position, in which the operator is indicating a desire for vehicle 8 to stop and a key-on position indicating a desire for vehicle 8 to move. If the most recent start is a key-on start, i.e., a start of the engine following the operator moving ignition switch 50 from the key-off to the key-on position, the adaption routine is conducted after engine conditions are appropriate, such as when air-fuel ratio control is operating closed loop. However, in the case of engine 10 being turned off under control of ECU 30 with ignition switch 50 remaining in the key-on position and the following start of engine 10 not being due to ignition switch 50 moving from the key-off to the key-on position, the adaption routine is conducted only after a predetermined duration of engine operation has elapsed.

Figure 2A:
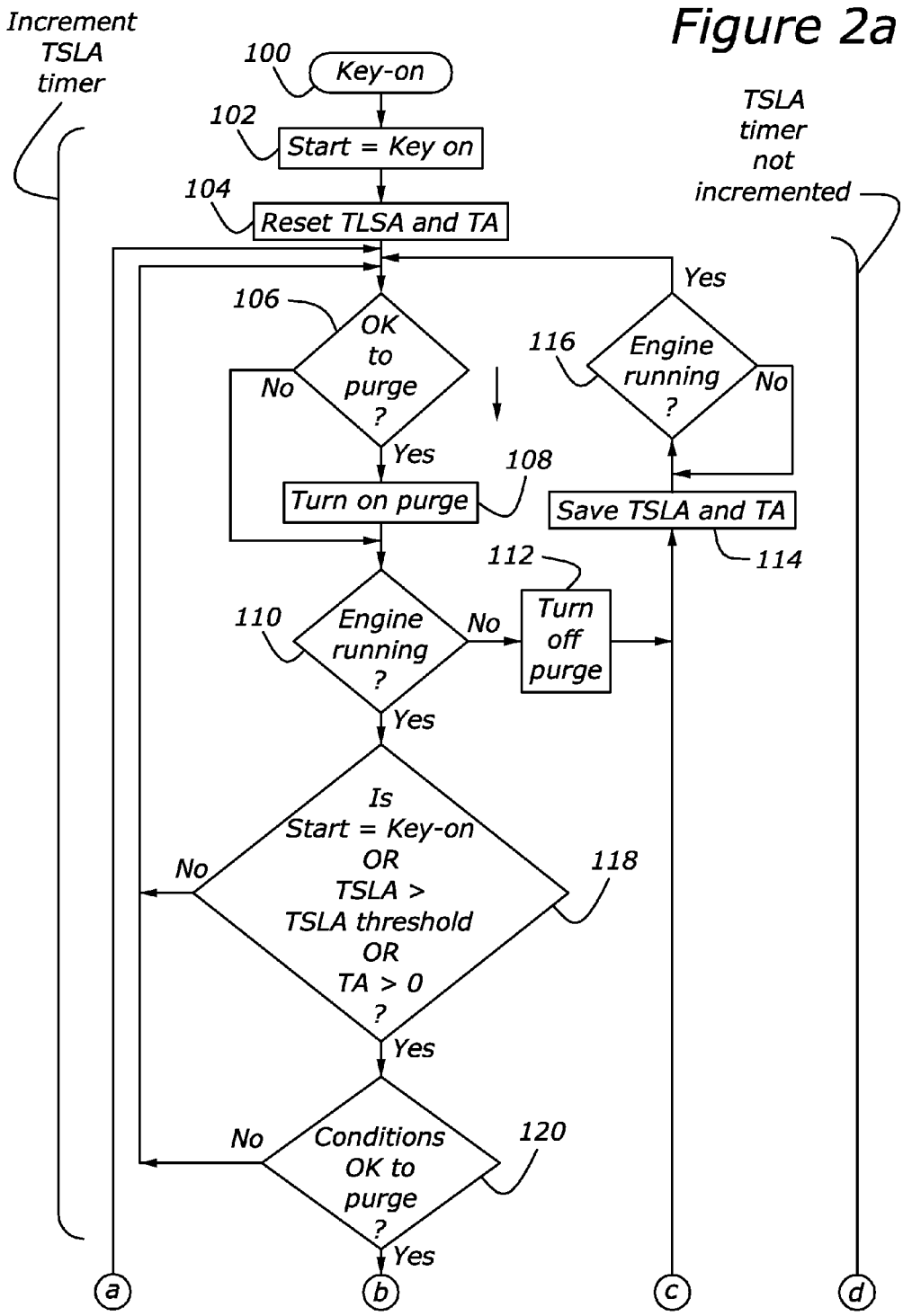
FIGS. 2*a* and 2*b* illustrate a flowchart of a control scheme according to one embodiment of the present disclosure.
Figure 2B:
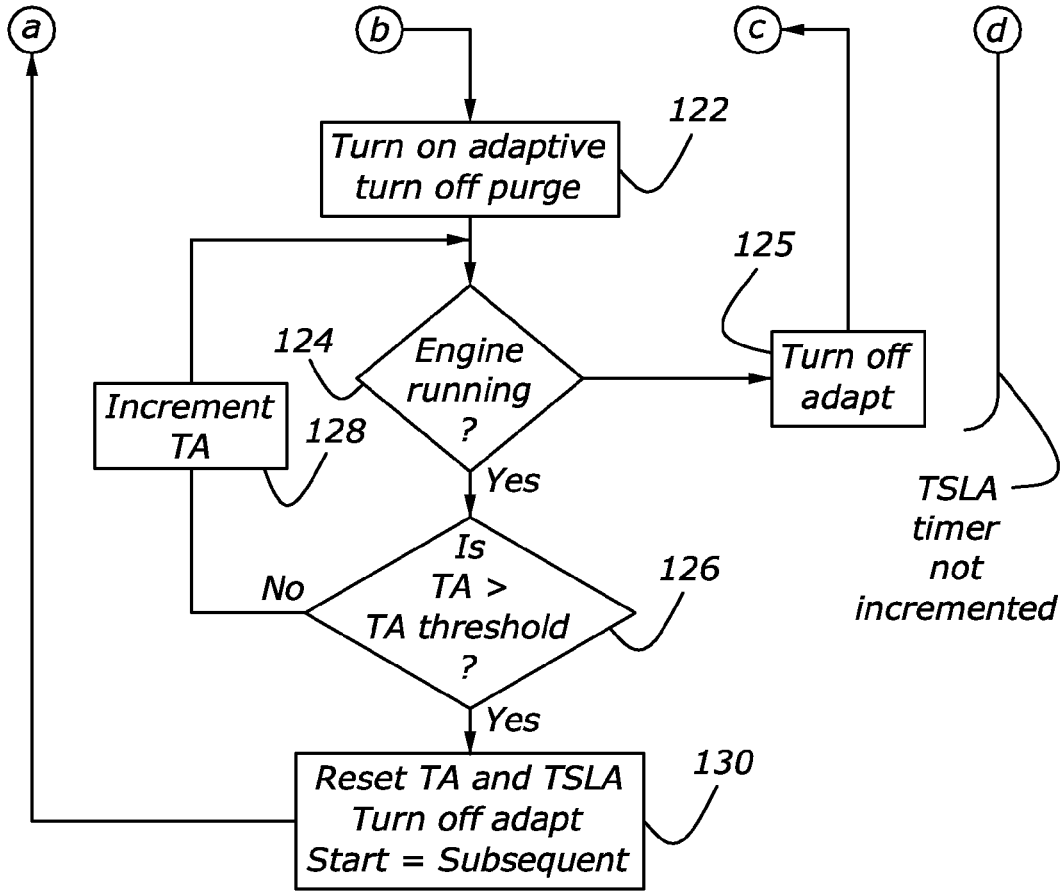

A flowchart illustrating one embodiment of the present disclosures is shown in FIGS. 2*a* and 2*b*. Starting in FIG. 2*a*, the flowchart starts with key-on in 100. This can be a literal key-on where the operator of the vehicle physically moves a key in an ignition indicating a desire to operate the vehicle or any device by which the operator makes such an intention known, such as push-button starting or remote starting. In 102, the type of start is set. Because this is a key-on start, Start is set to key-on. In 104, counters related to the adaption routine are reset to zero: time since last adapt (TSLA) and time of adaption (TA). TSLA keeps time since the last time that the adaption routine has been conducted and TA keeps time while an adaption routine is run. It may be desirable to conduct the adaption routine for about 40 seconds to ensure accuracy. Timer TA can be used to exit the adaption routine; the adaption routine is halted when TA exceeds a TA threshold. Alternatively, the open-loop and closed-loop air-fuel ratios can be sampled and the adaption routine stopped when they yield sufficiently similar results.

Continuing with FIG. 2*a*, control passes to decision 106 in which it is determined whether operating conditions are favorable for purging. Purging as frequently prevents carbon canister 40 from becoming saturated and unable to store fuel vapors during fuel tank 40 filling or daily heating/cooling cycles which leads to expansion/contraction of fuel tank 40 contents. The appropriate conditions may include: that catalyst 26 is at its operational temperature to handle any hydrocarbon spikes which may result from turning on purge and that air-fuel ratio is under closed-loop control, i.e., EGO 24 is warmed up enough to provide a reliable signal and that the adaption routine is not operating. If the conditions are favorable for purge, purge is activated in 108. If the conditions are not appropriate, control passes to 110 in which it is determined whether engine 10 is still operating. If not, purge is turned off in 112 and control passes to 114 in which timers TSLA and TA are saved. The incrementing of TSLA is not shown explicitly in the flowchart. However, TSLA is incremented while engine 10 is running. When 114 is accessed via 110 and 112 for the first time, TA is zero because it has not been incremented because no adaption routine has been conducted. TSLA reflects whatever time engine 10 has operated to the point that 114 is accessed. Control passes from 114 to 116 to determine if engine 10 is running. If not, it waits until engine 10 is running and if so, control passes to 106 in which it is determined whether it the conditions are favorable for purging.

When 110 yields a positive result, i.e., engine 10 is running, control passes to block 118 in which it is determined whether an adaption routine should be run. If any of the three tests in 118 is true (Boolean OR), 118 yields a positive result. If Start is equal to key on, then the adaption routine should be run. The first time through, at block 118, Start is still set to key on, thus 118 passes control to block 120. This will not be the case, however, after an adaption routine has been run for the first time. Another situation in which 118 yields a positive result is when TSLA exceeds a TSLA threshold. That is, if TSLA exceeds the TSLA threshold, i.e., indicating the frequency at which adaptions should be run, then 118 passes control to 120. Also in 118, if TA is greater than 0, it indicates that the adaption routine was interrupted the last time that it was conducted, in which case, the adaption is restarted by passing control to 120. If, however, none of the situations in 118 is true, control passes back to block 106 to determine whether it is OK to purge.

In 120 it is determined whether the operating conditions are favorable for conducting an adaption routine. Such conditions may include that engine coolant temperature is in a favorable range, indicating that engine 10 is sufficiently warmed up, and that engine 10 is operating under closed-loop control. If not, control passes to 106. If so, control passes to 122, shown in FIG. 2*b*, in which purge is disabled and adaption is initiated. Continuing to refer to FIG. 2*b*, control passes to block 124 in which it is once again determined whether engine 10 is operating. If not, control passes to 125 in which the purge is turned off and control passes to 114 in which the values of TSLA and TA are saved. The rest of this loop is explained elsewhere. If block 124 yields a positive result, control passes to 126 in which it is determined whether TA is greater than a threshold TA (the time that the adaption routine should be run). The first time that 126 is accessed, TA is zero and produces a negative result passing control to 128 in which TA is incremented. After sufficient time has elapsed in the adaption routine, TA has been incremented enough in 128 so that 126 yields a positive result and control passes to 130 in which: TA and TSLA are reset, the adaption routine is turned off, and Start is set to Subsequent. (Note that after the first adaption routine, the first condition tested in 118, FIG. 2*a*) is negative. Only the first time after key on will the first test in 118 be positive.) From 130 control passes back to 106 (of FIG. 2*a*) to determine whether purge can be restarted.

According to an embodiment of the present disclosure, by saving the value of TSLA and/or TA and incrementing based on the saved value, it avoids the adaption routine being run after every restart of the engine and allows the adaption routine to pick up where it left off, respectively. By avoiding unnecessary running of the adaption routine allows purging to occur more often thereby avoiding saturating the carbon canister.

While the best mode has been described in detail, those familiar with the art will recognize various alternative designs and embodiments within the scope of the following claims. The flowchart in FIGS. 2*a* and 2*b* illustrates one example process according to an embodiment of the disclosure. For example, decision blocks in FIGS. 2*a* and 2*b* may be conducted in a slightly different order, e.g., determining whether to conduct an adaption routine prior to determining whether it a favorable time to purge. Furthermore, the flowchart indicates a synchronous process. However, the process may be an asynchronous process with interrupt routines such as when engine 10 is shut off. Also, incrementing of TSLA while engine 10 is operating can be considered a separate routine operating simultaneously or could be shown explicitly in FIGS. 2*a* and 2*b*. A plethora of alternatives could be used to accomplish the salient operations of the present disclosure. Where one or more embodiments have been described as providing advantages or being preferred over other embodiments and/or over prior art in regard to one or more desired characteristics, one of ordinary skill in the art will recognize that compromises may be made among various features to achieve desired system attributes, which may depend on the specific application or implementation. These attributes include, but are not limited to: cost, strength, durability, life cycle cost, marketability, appearance, packaging, size, serviceability, weight, manufacturability, ease of assembly, etc. The embodiments described as being less desirable relative to other embodiments with respect to one or more characteristics are not outside the scope of the invention as claimed.

What is claimed:

1. A method for controlling an internal combustion engine disposed in a vehicle and receiving an air-fuel charge to operate, the method comprising: incrementing a time since last adaption (TSLA) timer while the engine is operating;

conducting an adaption routine when the TSLA timer exceeds a TSLA threshold, the adaption routine updating parameters used to estimate an open-loop air-fuel ratio of the air-fuel charge supplied to the engine;

resetting the TSLA timer in response to conducting the adaption routine; and saving the value of the TSLA timer when the engine is turned off and the key is on, wherein the saved TSLA timer value is used in the next incrementing of the TSLA timer.

2. The method of claim 1 wherein conducting the adaption routine is further based on engine coolant temperature being in a favorable range.

3. The method of claim 1, the vehicle including a carbon canister system for capturing fuel vapors, the method further comprising: disabling a purge function of the carbon canister system when the adaption routine is conducted.

4. The method of claim 1 wherein the updating parameters used to estimate an air-fuel ratio comprises:

operating in a closed-loop air-fuel control mode to maintain a predetermined air-fuel ratio;

estimating an open-loop air-fuel ratio based on present values of the parameters;

adjusting the values of the parameters used to estimate the open-loop air-fuel ratio when the difference between the predetermined air-fuel ratio and the open-loop air-fuel ratio differ by more than a threshold;

incrementing an adaption timer during the estimating and adjusting steps, the adaption timer being configured to measure an elapsed time that the adaption routine is conducted; and exiting the adaption routine and resetting the adaption timer when the adaption timer exceeds an adaption timer threshold.

5. The method of claim 1, the vehicle having an operator-selectable ignition switch having a key-on position and a key-off position, further comprising:

incrementing an adaption timer while the adaption routine is being conducted, the adaption timer being configured to measure an elapsed time that the adaption routine is conducted;

halting the adaption routine when the adaption timer exceeds an adaption timer threshold; and saving the value of the adaption timer when the engine is turned off and the ignition switch is in the key-on position, wherein the saved value of the adaption timer is used in the next incrementing of the adaption timer.

6. The method of claim 5, further comprising:

resetting both the TSLA timer and the adaption timer when the engine is turned on for the first time after key on.

7. A method for controlling an internal combustion engine disposed in a vehicle and receiving an air-fuel charge to operate, the vehicle having an operator-selectable ignition switch having a key-on position and a key-off position, the method comprising:

conducting an adaption routine when at least one engine condition is favorable and the engine is operating, wherein the adaption routine updates parameters used to estimate an open-loop air-fuel ratio of the air-fuel charge supplied to the engine, the adaption routine comprising: incrementing an adaption timer while the adaption routine is being conducted;

halting the adaption routine when the adaption timer exceeds an adaption timer threshold; and saving the value of the adaption timer when the engine is turned off while the ignition switch is in the key-on position, wherein the saved value of the adaption timer is used in the next incrementing step performed.

8. The method of claim 7, further comprising: resetting the adaption timer in response to the adaption timer exceeding the adaption timer threshold.

9. The method of claim 7, the method further comprising:

incrementing a time since last adaption (TSLA) timer while the engine is operating and the adaption routine is inactive, wherein the conducting an adaption routine step is further based on the TSLA timer exceeding a TSLA threshold;

resetting the TSLA timer in response to conducting the adaption routine; and saving the value of TSLA timer when the engine is turned off while the ignition switch is in the key-on position, wherein the saved TSLA timer value is used in the next incrementing of the TSLA timer.

10. The method of claim 7, the, further comprising:

activating purge of a carbon canister storage system when operating conditions are favorable; and deactivating the purge when the adaption routine is being conducted.

11. The method of claim 10 wherein favorable conditions comprises at least one of: the engine operating under closed-loop air-fuel ratio control and a temperature in a catalyst coupled to an exhaust of the engine being above a threshold temperature.

12. The method of claim 7, wherein the updating parameters used to estimate an open-loop air-fuel ratio comprising:

operating in a closed-loop air-fuel control mode maintaining a predetermined air-fuel ratio;

estimating an open-loop air-fuel ratio based on present values of the parameters; and adjusting the values of the parameters used to estimate the open-loop air-fuel ratio when the difference between the predetermined air-fuel ratio and open-loop air-fuel ratio differ by more than a threshold.

13. A method to control an internal combustion engine in a vehicle, comprising:

detecting an engine start;

characterizing the engine start as a key-on start or a subsequent start;

incrementing a time since last adaption (TSLA) timer while the engine is operating;

conducting an adaption routine when the TSLA timer exceeds a TSLA threshold, the adaption routine updating parameters used to estimate an open-loop air-fuel ratio of the air-fuel charge supplied to the engine;

resetting the TSLA timer in response to detection of the key-on start;

saving a value of the TSLA timer in response to detection of the subsequent start; and using the saved TSLA timer value in the next incrementing of the TSLA timer.

14. The method of claim 13, further comprising:

incrementing an adaption timer while the adaption routine is being conducted;

halting the adaption routine when the adaption timer exceeds an adaption threshold; and resetting the adaption routine when the adaption timer in response to halting the adaption routine.

15. The method of claim 13, further comprising:

saving a value of the adaption timer in response to detection of the subsequent start; and using the saved adaption timer value in the next incrementing of the adaption timer.

16. The method of claim 13, the vehicle including a carbon canister system for capturing fuel vapors, the method further comprising:

activating a purging routine of the carbon canister system when the adaption routine is inactive and engine operating conditions are suitable for a purging routine.

17. The method of claim 16 wherein suitable operating conditions comprise: the engine operating under closed-loop air-fuel ratio control and a temperature in a catalyst coupled to an exhaust of the engine being above a threshold temperature.

18. The method of claim 16, the carbon canister system having a purge valve disposed between the carbon canister and the engine, wherein the purging routine comprises commanding the purge valve to at least partially open.

19. The method of claim 16, further comprising:

interrupting the purging routine when the TSLA timer exceeds a TSLA threshold.

* * * * *